US006995124B1

(12) United States Patent
Wernicke et al.

(10) Patent No.: US 6,995,124 B1
(45) Date of Patent: Feb. 7, 2006

(54) METHODS FOR LAUNDERING DELICATE GARMENTS IN A WASHING MACHINE

(75) Inventors: Todd Michael Wernicke, Cincinnati, OH (US); Freddy Arthur Barnabas, West Chester, OH (US); Michelle Frances Mellea, Hamilton, OH (US); John Downing Curry, Oxford, OH (US); Michael P. Siklosi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/830,251

(22) PCT Filed: Oct. 22, 1999

(86) PCT No.: PCT/US99/24938

§ 371 (c)(1),
(2), (4) Date: Jul. 11, 2001

(87) PCT Pub. No.: WO00/24860

PCT Pub. Date: May 4, 2000

Related U.S. Application Data

(60) Provisional application No. 60/105,539, filed on Oct. 24, 1998, provisional application No. 60/157,082, filed on Oct. 1, 1999, provisional application No. 60/157,399, filed on Oct. 1, 1999.

(51) Int. Cl.
*D06L 1/12* (2006.01)

(52) U.S. Cl. ..... 510/285; 510/276; 510/283; 510/329; 510/330; 510/515; 510/519; 8/137; 8/142; 383/81; 383/82; 383/83; 383/84; 383/85; 383/86; 383/98; 383/99; 383/101; 383/103; 383/124

(58) Field of Classification Search ..... 8/137, 8/142; 383/81, 82, 83, 84, 85, 86, 98, 99, 383/101, 103, 124; 510/276, 283, 285, 329, 510/330, 515, 519
See application file for complete search history.

(56) References Cited

U.S. PATENT DOCUMENTS

| | | | | |
|---|---|---|---|---|
| 503,355 | A | 8/1893 | Phlilips | |
| 1,385,695 | A | 7/1921 | MacCormack | |
| 3,029,852 | A | 4/1962 | Taylor | |
| 3,906,753 | A * | 9/1975 | Siegfried | 66/170 |
| 4,102,825 | A | 7/1978 | Murata et al. | |
| 4,195,378 | A | 4/1980 | Parker | |
| 4,267,077 | A | 5/1981 | Niimi et al. | |
| 4,336,024 | A | 6/1982 | Rossard et al. | |
| 4,421,657 | A | 12/1983 | Allen et al. | |
| 4,662,517 | A | 5/1987 | Wirth | |
| 4,714,479 | A | 12/1987 | Wilsberg | |
| 4,746,455 | A | 5/1988 | Matsuda et al. | |
| 4,750,907 | A | 6/1988 | Wilsberg | |
| 4,781,041 | A | 11/1988 | Fowler | |
| 4,846,982 | A | 7/1989 | Madore et al. | |
| 4,911,852 | A | 3/1990 | Coffindaffer et al. | |
| 4,978,462 | A | 12/1990 | Sheppard | |
| 4,978,471 | A | 12/1990 | Starch | |
| 4,989,995 | A * | 2/1991 | Rubenstein et al. | 383/117 |
| 5,026,489 | A | 6/1991 | Snow et al. | |
| 5,057,240 | A | 10/1991 | Madore et al. | |
| 5,091,105 | A | 2/1992 | Madore et al. | |
| 5,110,506 | A | 5/1992 | Ciallella | |
| 5,114,706 | A | 5/1992 | DuVel | |
| 5,199,120 | A | 4/1993 | Holmes | |
| 5,254,269 | A | 10/1993 | Taylor et al. | |
| 5,288,431 | A | 2/1994 | Huber et al. | |
| 5,354,491 | A | 10/1994 | Bjorkquist et al. | |
| 5,536,493 | A | 7/1996 | Dubief | |
| 5,614,484 | A | 3/1997 | Panandiker | |
| 5,648,327 | A | 7/1997 | Smerznak et al. | |
| 5,661,988 | A | 9/1997 | Oh et al. | |
| 5,674,832 | A | 10/1997 | Keys | |
| 5,681,355 | A * | 10/1997 | Davis et al. | 8/137 |
| 5,681,808 | A | 10/1997 | Kobayashi et al. | |
| 5,687,591 | A * | 11/1997 | Siklosi et al. | 68/212 |
| 5,714,446 | A | 2/1998 | Bartz et al. | |
| 5,723,426 | A | 3/1998 | Zhen et al. | |
| 5,747,433 | A | 5/1998 | Wahl et al. | |
| 5,753,079 | A | 5/1998 | Jenny et al. | |
| 5,759,208 | A | 6/1998 | Zhen et al. | |
| 5,759,990 | A | 6/1998 | Wahl et al. | |
| 5,762,647 | A | 6/1998 | Kaiser | |
| 5,789,368 | A | 8/1998 | You et al. | |

(Continued)

FOREIGN PATENT DOCUMENTS

| | | |
|---|---|---|
| DE | 25 47 588 | 4/1977 |

(Continued)

OTHER PUBLICATIONS

Jumbo Size Laundry Net—Advertisement (Japanese Translation Attached).

*Primary Examiner*—Charles Boyer
(74) *Attorney, Agent, or Firm*—Julia A. Glazer; Kim William Zerby; Steven W. Miller

(57) ABSTRACT

A product and process for laundering delicate or dry-clean only garments in a conventional home washing machine. The process represents a home version of the commercial wet-cleaning processes for cleaning of delicate garments. The product comprises a liquid combination washing/conditioning composition and optionally a wash pretreatment composition, a flexible wrap container within which the garments are contained during washing and a pretreatment applicator.

11 Claims, 3 Drawing Sheets

U.S. PATENT DOCUMENTS

| | | | |
|---|---|---|---|
| 5,824,635 | A | 10/1998 | Keys |
| 5,830,845 | A | 11/1998 | Trinh et al. |
| 5,861,370 | A | 1/1999 | Trinh et al. |
| 5,877,145 | A | 3/1999 | Wahl et al. |
| 5,977,055 | A | 11/1999 | Trinh et al. |
| 6,040,286 | A | 3/2000 | Huff |
| 6,053,952 | A | 4/2000 | Brown et al. |
| 6,061,849 | A | 5/2000 | Seals |
| 6,139,587 | A | 10/2000 | Nair et al. |
| 6,223,367 | B1 | 5/2001 | French et al. |
| 6,323,172 | B1 | 11/2001 | Trinh et al. |
| 6,335,315 | B1 | 1/2002 | Trinh et al. |
| 6,369,025 | B1 | 4/2002 | Trinh et al. |
| 2003/0008799 | A1 | 1/2003 | Barnabas et al. |

FOREIGN PATENT DOCUMENTS

| | | | |
|---|---|---|---|
| DE | 28 32 679 | | 2/1979 |
| DE | 34 11 084 | | 1/1986 |
| DE | 286179 | A5 | 1/1991 |
| DE | 386179 | A5 | 1/1991 |
| EP | 0 387 658 | | 9/1990 |
| EP | 0 394 689 | | 10/1990 |
| EP | 0 630 855 | | 12/1994 |
| EP | 0 342 834 | B1 | 1/1995 |
| EP | 1 018 541 | | 7/2000 |
| GB | 2 054 635 | | 2/1981 |
| GB | 2 078 670 | | 1/1982 |
| GB | 2 245 281 | A | 1/1992 |
| GB | 2 245 281 | A | 2/1992 |
| GB | 2 302 553 | | 1/1997 |
| GB | 2 330 148 | A | 4/1999 |
| JP | 09-242905 | | 9/1986 |
| JP | 08-029757 | | 6/1987 |
| JP | 02-180296 | | 7/1990 |
| JP | 04-036394 | | 2/1992 |
| JP | 04-144592 | | 5/1992 |
| JP | 06-293499 | | 1/1993 |
| JP | 05-239493 | | 9/1993 |
| JP | 05-293290 | | 11/1993 |
| JP | 06-065803 | | 3/1994 |
| JP | 07-080184 | | 3/1995 |
| JP | 07-124377 | | 5/1995 |
| JP | 07-289778 | | 11/1995 |
| JP | 07-328279 | | 12/1995 |
| JP | 08-098986 | | 4/1996 |
| JP | 08-196778 | | 8/1996 |
| JP | 09-056973 | | 3/1997 |
| JP | 09-067594 | | 3/1997 |
| JP | 09-075580 | | 3/1997 |
| JP | 09-105077 | | 4/1997 |
| JP | 09-131489 | | 5/1997 |
| JP | 09-140988 | | 6/1997 |
| JP | 09-201487 | | 8/1997 |
| JP | 09-215892 | | 8/1997 |
| JP | 09-220394 | | 8/1997 |
| JP | 09-234294 | | 9/1997 |
| JP | 09-271597 | | 10/1997 |
| JP | 10-005487 | | 1/1998 |
| JP | 10-015282 | | 1/1998 |
| JP | 10-015283 | | 1/1998 |
| JP | 10-015284 | | 1/1998 |
| JP | 10-015285 | | 1/1998 |
| JP | 10-028790 | | 2/1998 |
| JP | 10-057667 | | 3/1998 |
| JP | 10-060480 | | 3/1998 |
| JP | 10-060483 | | 3/1998 |
| JP | 10-071295 | | 3/1998 |
| JP | 10-118386 | | 5/1998 |
| JP | 10-137486 | | 5/1998 |
| JP | 10-151292 | | 6/1998 |
| JP | 10-158693 | | 6/1998 |
| JP | 10-158962 | | 6/1998 |
| JP | 10-179499 | | 7/1998 |
| JP | 10-201992 | | 8/1998 |
| JP | 10-235074 | | 9/1998 |
| JP | 10-249090 | | 9/1998 |
| JP | 10-251962 | | 9/1998 |
| JP | 10-305188 | | 11/1998 |
| JP | 11-004992 | | 1/1999 |
| JP | 08-218855 | | 3/1999 |
| JP | 11-057278 | | 3/1999 |
| JP | 11-076677 | | 3/1999 |
| JP | 11-123297 | | 5/1999 |
| JP | 11-156083 | | 6/1999 |
| JP | 11-169587 | | 6/1999 |
| JP | 11-172592 | | 6/1999 |
| JP | 11-197387 | | 7/1999 |
| JP | 11-207079 | | 8/1999 |
| JP | 11-253689 | | 9/1999 |
| JP | 11-300079 | | 11/1999 |
| JP | 11-300080 | | 11/1999 |
| JP | 11-319369 | | 11/1999 |
| JP | 11-333195 | | 12/1999 |
| JP | 11-347284 | | 12/1999 |
| JP | 00-14965 | | 1/2000 |
| JP | 00-024376 | | 1/2000 |
| JP | 00-070587 | | 3/2000 |
| JP | 00-107486 | | 4/2000 |
| JP | 00-116981 | | 4/2000 |
| JP | 00-116983 | | 4/2000 |
| WO | WO 97/00992 | | 1/1997 |
| WO | WO 97/03169 | | 1/1997 |
| WO | WO 97/07278 | | 2/1997 |
| WO | WO 97/12019 | | 4/1997 |
| WO | WO 97/12022 | | 4/1997 |
| WO | WO 97/12027 | | 4/1997 |
| WO | WO 97/27354 | | 7/1997 |
| WO | WO 97/41291 | | 11/1997 |
| WO | WO 98/04770 | | 2/1998 |
| WO | WO 99/12988 | | 3/1999 |
| WO | WO 99/18177 | | 4/1999 |
| WO | WO 00/24857 | | 5/2000 |
| WO | WO 00/24860 | | 5/2000 |
| WO | WO 00/24958 | | 5/2000 |

* cited by examiner

METHODS FOR LAUNDERING DELICATE GARMENTS IN A WASHING MACHINE

This application claims the benefit of U.S. Provisional Applications No. 60/105,539, filed Oct. 24, 1998, 60/157,082 filed Oct. 1, 1999 and 60/157,399 filed Oct. 1, 1999.

TECHNICAL FIELD

The present invention relates to a product and process for laundering delicate or dry-clean only garments in a conventional home washing machine.

BACKGROUND OF THE INVENTION

By definition, the term "dry cleaning" has been used to describe processes for cleaning textiles using non-aqueous solvents. Dry cleaning is an old art with solvent cleaning first being recorded in the United Kingdom in the 1860s. Typically, dry cleaning processes are used with delicate fabrics such as wool and silk which are subject to shrinkage in aqueous laundering baths, or which are judged to be too valuable or delicate to be subjected to aqueous laundering processes. Such garments usually have a tag affixed to them either identifying the garment as "dry clean only" or providing some other appropriate laundering tocsin. For the last fifty years, the most widely-used non-aqueous solvent of choice for commercial dry-cleaning has been perchloroethylene.

While perchloroethylene is superior to the non-aqueous solvents that it replaced, it has several disadvantages. In particular perchloroethylene has been identified as a hazardous air pollutant by the U.S. Environmental Protection Agency and has been long associated with nervous-system and kidney disorders among industrial workers. In 1995, the Environmental Protection Agency classified perchloroethylene as a "probable human carcinogen." Perchloroethylene's potential carcinogenic effects are not limited solely to industrial workers or those who operate perchloroethylene-based dry clean processes: a recent study of commercial dry cleaners in New York revealed that many of these cleaners used such high amounts of perchloroethylene to clean garments, that customers who wore freshly dry-cleaned garments could inhale enough perchloroethylene to incur a slightly increased risk of cancer. As a consequence of the hazardous nature of perchloroethylene, dry cleaning processes utilizing perchloroethylene must be done at commercial establishments. Not only is this both inconvenient and expensive, but it can expose delicate and quite possibly expensive garments to dry-cleaning processes of inconsistent quality and garment care. Many consumers who have taken their goods to a commercial dry-cleaner have reported them being damaged either by excessive shrinking, discoloration or tearing. The use of perchloroethylene in commercial dry-cleaning establishments also tends to leave a "chemical" smell on clothing that consumers find unsatisfactory.

Moreover, while solvent-based dry cleaning processes are quite effective for removing oily soils and stains, they are not optimal for removing particulates such as clay soils or the water-soluble stains such as the sugars commonly found in many fruit drinks and carbonated beverages, and may require special treatment conditions to remove proteinaceous stains.

Given the foregoing, there is a continuing need for a method or process that provides excellent cleaning benefits on a variety of stains and soiling conditions and imparts a "fresh" and "clean" scent to delicate or dry-clean only goods without the use of hazardous or harmful chemicals. Accordingly, it is a feature of the present invention to provide a process for cleaning delicate or dry-clean only garments that uses non-toxic and non-hazardous chemicals to provide superior cleaning benefits on a wide variety of soils and stains. Such a method or process should also be relatively convenient and inexpensive and be without the possible garment damage and adverse "chemical" scent that is sometimes the result of commercial dry-cleaning.

Ideally, particulates and proteinaceous stains, as well as oily soils and stains, are removed from fabrics using detersive ingredients and under operating conditions which are more akin to aqueous laundering processes than to conventional dry cleaning. Such aqueous laundry processes also consistently impart a "freshness" or "clean" scent to fabric, rather than the "chemical" smell that is often found when perchloroethylene or other non-aqueous solvents are used.

Perhaps the most widely practiced aqueous laundering process is that which the consumer performs when she or he immerses a garment into an aqueous laundry detergent solution in a conventional home washing machine. Such a process has long been shown to provide excellent performance for both stain removal and overall garment cleaning and can be performed without using hazardous or toxic chemicals. Moreover, the use of an aqueous laundering process in a conventional washing machine is considerably more convenient and inexpensive than virtually any other laundering method.

Nonetheless, such processes can produce unacceptable results when applied to a broad range of delicate or dry-clean only garments, such as those made from wool. Wool, is made up of a fibers which can interlock with one another by a series of "scales". Generally, these interlocking scales cannot move past one another and as a result wool is a relatively strong textile. However, when wool becomes wet or moistened then the water provides lubrication by which the scales may move past one another in a preferential direction if sufficient force is exerted in that direction; such force may be provided by the agitation experienced in a washing machine. When the fibers move in this preferential direction, then the wool garment shrinks. This shrinkage cannot be undone because these "scales" can only move past one another in a preferred direction. Sufficient force cannot be exerted to move them in the direction opposite to the preferred direction to undo the shrinkage. Thus when the wool garment is removed from the aqueous laundry process, shrinkage has occurred and the garment is irreversibly damaged. Similarly rayon, when saturated with water, becomes extremely weak and the subsequent agitation and abrasion that it experiences in a typical aqueous laundry process is likely not only to cause severe damage to the garment but also to leave it extremely wrinkled. Similarly, delicate fabrics like silk will not only be severely wrinkled but also may lose their desirable soft feel.

Garments such as silks are also vulnerable not only to the mechanical agitation of a conventional washing machine but are also particularly vulnerable to the typical laundry detergents because such detergents may contain ingredients that are too harsh for such delicate fabrics. It is thus a further benefit of the present invention to provide an aqueous laundering process adapted for use in a conventional washing machine that is not harmful to garments made from fabrics such as wool, rayon, silk, acrylics, triacetates, fine cottons and blends of these aforementioned materials.

A system has been devised in the present invention to provide the traditional cleaning, brightening and freshening benefits of an aqueous laundering process without the deleterious consequences to delicate and dry-clean only fabrics described above. The system uses a flexible, polymer wrap container. When a garment is secured within this container, the garment is buffered and cushioned from the force and stress caused by the agitator. The system also uses liquid detergent compositions which are modified to be mild on delicate garments. A first liquid detergent composition is used to pre-treat stains, to enhance the cleaning efficacy on the stains. The system may provide an applicator (to distribute the pretreat compositions over the surface of the stain) and, optionally a special stain-absorbent pad which the consumer may use to pretreat a stain before it is placed in the washing machine. In addition, the present invention also makes use of a second detergent composition which is a combination of both a cleaning composition and conditioner to improve color fidelity, provide anti-wrinkling benefits and reduce fabric abrasion as well as providing other fabric care benefits.

When used according to the processes described herein, this system provides a consumer with a convenient, inexpensive, and efficacious way to clean delicate and dry-clean only garments in the home.

SUMMARY OF THE INVENTION

By the present invention, a process and the kit for performing that process have been found by which delicate and dry-clean only garments can be cleaned and freshened in an aqueous laundering process without damaging the garment. An aqueous laundry process performed in a conventional home washing machine is particularly envisioned. Accordingly, the present invention solves the long-standing need for an inexpensive and convenient process of cleaning dry-clean only and other delicate garments in a conventional home washing machine. The process of the present invention provides equal to superior overall cleaning of garments when compared to a commercial dry-cleaning establishment using perchloroethylene but without the use of hazardous chemicals or the deposition of chemical malodors on the garment. An essential component of the present invention is a liquid combination washing/conditioning composition which comprises an anionic surfactant, a quaternary ammonium surfactant, a silicone softening agent and an optionally emulsifier; the anionic surfactant to quaternary ammonium surfactant weight ratio is from about 2:1 to about 3:1. The kit also comes with a flexible wrap container and instructions for using the container to launder garments in a conventional home washing machine.

The flexible wrap container is designed to contain and protect delicate or dry-clean only clothes from being subjected to the agitation action of a washing machine. The basic part of the flexible wrap container is a flexible rectangular panel constructed of a woven polyester or woven nylon layer.

There is also provided a process for cleaning garments using the kit provided with this invention. This process encompasses placing the fabrics and textiles within the flexible wrap container described above and then placing the flexible wrap container together with an effective amount of a liquid combination washing/conditioning composition inside a washing machine and then operating the washing machine as prescribed by the manufacturer.

All percentages, ratios and proportions herein are by weight, unless otherwise specified. All documents cited are, in relevant part, incorporated by reference.

DETAILED DESCRIPTION OF THE INVENTION

Figure 1:
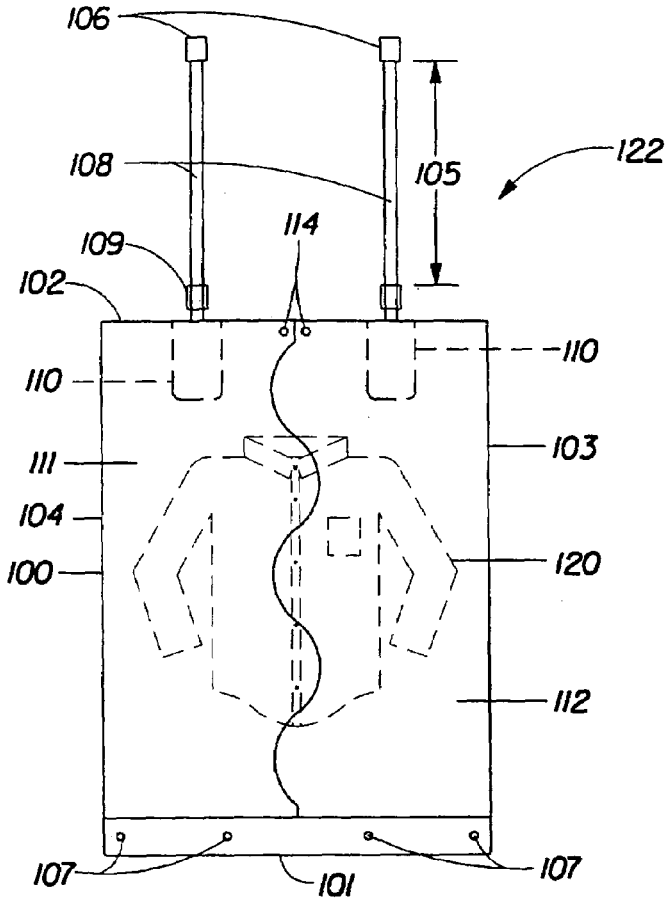
FIG. 1 is a side view illustrating the flexible wrap container 122.

The present invention provides a "kit" which contains the necessary materials to enable a consumer to clean delicate or dry-clean only garments in a conventional, home washing machine with superior cleaning performance but without significant damage or the adverse effects typically associated with aqueous garment cleaning. At a minimum, the kit includes a liquid cleaning composition specially formulated for treating and cleaning delicate and dry-clean only garments, a rinse cycle conditioner and a flexible wrap container.

The kit may also include: a wash pretreatment composition, one or more wash pretreatment applicators, an apparatus for dispensing a rinse cycle conditioner and multiple absorbent stain receiver pads.

The flexible wrap container disclosed by the present invention provides significant benefits over similar devices in use today. In particular, it offers a superior means for securing and closing itself, thereby limiting the chance that garments will spill out of it and be damaged while being laundered in a washing machine. Additionally, the thickness of the flexible wrap container insulates and protects the garment or garments contained therein from the stress and abrasion that may be caused by the agitator and other internal parts of a washing machine. The flexible wrap container further offers an expandability and versatility that is not seen in other such devices: not only is the flexible wrap container larger than competing devices, it has a series of connecting means (e.g. snaps) which allow two identical flexible wrap containers to be joined together to provide an additional flexible wrap container of twice the original capacity at no extra cost to the consumer. This further enhances the size retention benefits of the present invention.

The present invention further provides a wash pretreatment applicator intended to be affixed on a human finger, that is used to apply the wash pretreatment composition to the stained area of a garment. The wash pretreatment applicator is a highly useful tool by which stain removal agent may be applied to the stained area of a garment with enhanced convenience and efficacy.

When these separate components are taken and used together, the result is an innovative process and a kit for performing that process by which delicate and dry-clean only garments can be cleaned and freshened in an aqueous laundering process without damaging the garments. An aqueous laundry process performed in a conventional home washing machine is particularly envisioned.

Definitions

By "aqueous compositions" herein is meant compositions which comprise a major portion of water.

By "solution" herein is meant a liquid mixture of ingredients. As used herein "solution" does not convey or imply the existence of only a single liquid or solid phase. Nor is it meant to describe a homogenous solvent/solute system.

By "effective amount" herein is meant any amount capable of measurably improving stain removal from a localized area of a garment. In general, this amount may vary quite widely.

By "cleaning" herein is meant the removal of soils and stains from fabrics.

By "contact with stained areas" with respect to the wash pretreatment applicator is meant contact which is afforded by the impingement of the soft bristles which comprise the brush means of the device with the one side of the stained area. By "contact with the stained areas" with respect to the absorbent stain receiver pad is meant that the side of the stained area of the fabric opposite the wash pretreatment applicator directly impinges on the receiver and is in close communication therewith.

The components of the devices of this invention and their method of use are described in more detail hereinafter.

The Wash Pretreatment Composition and the Combination Washing/Conditioning Detergent Composition Some laundry detergent compositions are too harsh to treat delicate and dry-clean only garments. In particular, detergent ingredients such as certain surfactants, enzymes and bleaches can cause serious damage (garment discoloration in particular) to delicate and dry-clean only garments. Accordingly, the liquid cleaning compositions of the present invention, should most preferably be substantially free of bleaches and include an enzyme cocktail that is less harsh than the enzymes typically used in a laundry detergent composition. Stated otherwise, the liquid cleaning compositions herein should be formulated so as not to damage fabrics by causing discoloration, abrasion or other adverse effects.

Consequently, while conventional laundry detergents are usually formulated to provide good cleaning on cotton and cotton/polyester blend fabrics, the compositions here must be formulated to also safely and effectively clean and refresh fabrics such as wool, silk, rayon, alpaca fleece, fine cotton and blends of the aforementioned fabrics. In addition, the compositions herein comprise ingredients which are specially selected and formulated to minimize the migration of fugitive dyes.

Accordingly, the present invention includes both a wash pretreatment composition and a combination washing/conditioning composition—the latter providing both detersive-cleaning benefits and conditioning and softening benefits in a single composition. The wash pretreatment composition is distributed over the surface of a stained area of the garment by the use of an applicator (described in greater detail herein) after which the stained area of the garment is optionally rinsed off with water.

The washing/conditioning composition is then subsequently mixed with water in a washing machine in the customary fashion to form an aqueous laundry detergent solution suitable for immersion cleaning of garments.

It has now been discovered that when the applicator, the washing/conditioning composition and the wash pretreatment composition are used in the manner described herein, excellent spot and stain removal performance is obtained even though these detergent compositions are specially formulated to be mild and gentle. In addition to the foregoing considerations, the wash pretreatment composition used herein is preferably formulated such that it is easily dispensed and not so adhesive in nature that it renders the stain-removal applicator unwieldy or difficult to use. It is understood that the "active adjunct" materials used will vary, depending on the intended end-use of the final composition. The following are intended only to be nonlimiting illustrations of such active adjuncts, more examples of which will readily come to mind of the skilled formulator.

Part the First: the Wash Pretreatment Composition

The wash pretreatment composition as an optional component of the present invention and may be selected from the following suitable ingredients which will now be discussed in seritam.

Detersive Surfactants—Surfactants are known to have potentially harsh effects on fabrics. Typically, the compositions herein will comprise from about 3% to about 40%, more preferably from about 10% to about 25%, most preferably from about 15% to about 20%, by weight of detersive surfactants.

Nonlimiting examples of surfactants useful herein include the unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, the $C_{10-18}$ glycerol ethers, the $C_{10}$–$C_8$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful and cationic and amphoteric surfactants may also be used. Other conventional useful surfactants are listed in standard texts.

Builders—The compositions of the present invention preferably comprise one or more detergent builders or builder systems. When present, the compositions will typically comprise from about 0.01% to about 35%, more preferably from about 1% to about 25%, most preferably from about 2% to about 8% by weight, of detergent builder.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Citrate builders, e.g., citric acid and soluble salts thereof (particularly sodium salt), are polycarboxylate builders of particular importance for the present detergent formulations due to their availability from renewable resources and their biodegradability.

Fatty acids are also important carboxylate builders for the present invention. The fatty acids disclosed herein may contain from about 1 to about 10 ethylene oxide units in the hydrocarbon chain. Preferred are saturated fatty acids containing from about 12 to about 16 carbon atoms.

Suitable saturated fatty acids can be obtained from natural sources such as plant or animal esters (e.g., stripped palm kernel oil, stripped palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids, from about 5:1 to 1:1 (preferably about 3:1) weight ratio mixtures of lauric and myristic acid, mixtures of the above with minor amounts (e.g., 10%–30% of total fatty acid) of oleic acid; and stripped palm kernel fatty acid.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Enzymes—Enzymes can be included in the formulations herein for a wide variety of fabric laundering purposes, including removal of protein-based, carbohydrate-based, or triglyceride-based stains; for the prevention of fugitive dye transfer. Certain enzymes also provide fabric restorative benefits by decomposing and degrading the loose and frayed fibers on the surface of a textile article, particularly textile articles made from silk or wool.

The enzymes to be incorporated include proteases, amylases, lipases, and mannanases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. Protease is an acceptable enzyme because of its well-known cleaning benefits on a variety of organic-material stains. Enzymes such as cellulases and peroxidases are less desirable because of their potentially harsh effects on delicate garments and in an optimal composition, they are not present.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.005 to 0.1 Anson units (AU) of activity per gram of composition.

Further examples of enzymes suitable for use in the present invention can be found in the copending provisional application of Boutique et al., entitled "Detergent Compositions Comprising Improved Hydrotropes," Ser. No. 60/150,233, having been filed on Aug. 23, 1999.

Enzyme Stabilizing System—The compositions of the present invention may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One possible stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions may further comprise from 0% to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during fabric washing, can be relatively large; accordingly, enzyme stability to chlorine in-use is sometimes problematic. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

The compositions of the present invention may contain any of the water-soluble formates described in U.S. Pat. No. 4,318,818, Letton et al, issued Mar. 9, 1982, incorporated herein by reference. Formate is present at a level of from about 0.05% to about 5%, preferably from about 0.2% to about 2%, most preferably from about 0.4% to about 1.5%, by weight of the composition.

Other suitable detergent ingredients that can be added are enzyme stabilizers are the enzyme oxidation scavengers which are described in Copending European Patent application 92870018.6 filed on Jan. 31, 1992. Examples of such enzyme oxidation scavengers are ethoxylated tetraethylene polyamines.

Further compounds and techniques suitable for enzyme stabilization and chlorine scavenging for use in the present invention can be found in the copending provisional application of Curry et al., entitled "Methods for Laundering Delicate Garments in a Washing Machine," Ser. No. 60/157,399, filed Oct. 1, 1999.

Particulate Soil Removal/Anti-redeposition Agents—The compositions of the present invention can also optionally contain water-soluble ethoxylated amines having particulate soil removal and antiredeposition properties. Liquid detergent compositions typically contain about 0.01% to about 5%.

The most preferred soil release and anti-redeposition agent is ethoxylated tetraethylene-Pentamine ("TEPA"). On average tetraethylene-pentamine is ethoxylated with 15–18 moles of ethylene oxide at each hydrogen site. Exemplary ethoxylated amines are further described in U.S. Pat. No. 4,597,898, VanderMeer, issued Jul. 1, 1986. Another group of preferred particulate soil removal-antiredeposition agents are the cationic compounds disclosed in European Patent Application 111,965, Oh and Gosselink, published Jun. 27, 1984. Other particulate soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other particulate soil removal and/or anti redeposition agents known in the art can also be utilized in the compositions herein. Another type of preferred antiredeposition agent includes the carboxy methyl cellulose (CMC) materials. These materials are well known in the art.

Dye Transfer Inhibiting Agents—An important part of the present invention is providing color care for delicate garments and fabrics which are cleaned according to the aqueous cleaning processes described herein. Thus, the compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

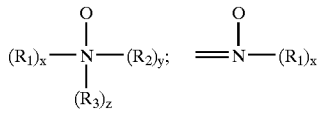

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

An example of a dye transfer inhibiting agent is poly(4-vinylpyridine-N-oxide) which can be referred to as "PVNO". Also suitable are copolymers of N-vinylpyrrolidone and N-vinylimidazole polymers (referred to as a class as "PVPVI") as well as polyvinylpyrrolidone ("PVP"). These are discussed in greater detail in U.S. Pat. No. 5,759,208, to Zhen et al., issued Jun. 2, 1998, which is hereby incorporated by reference.

Additional Color Care Agents—In addition to the dye transfer inhibitors, the present invention further comprises an additional agent to provide color care benefits: 30 polyethyleneimine, PEI 600 E20, having the general formula:

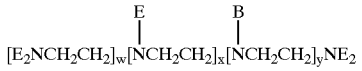

wherein B is a continuation by branching of the polyethyleneimine backbone. E is an ethyleneoxy unit having the formula:

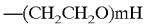

wherein m has an average value of about 20. What is meant herein by an average value of 20 is that sufficient ethylene oxide or other suitable reagent is reacted with the polyethyleneimine starting material to fully ethoxylate each N—H unit to a degree of 20 ethoxylations. However, those skilled in the art will realize that some N—H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$H_2N—CH_2CH_2]—$ and $—NH_2$ which terminate the main backbone and any branching chains, secondary amine units having the formula:

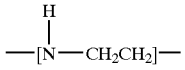

and which, after modification, have their hydrogen atom substituted by an average of 20 ethyleneoxy units, and tertiary amine units having the formula:

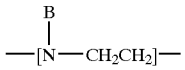

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones, cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present. The average molecular weight for each ethylene backbone unit, $—NCH_2CH_2—$, is approximately 43 daltons.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −15° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by M. S. Starch.

Additional suds suppressers may be selected from those silicones discussed below in this application in the section on silicone softening agents and in U.S. Pat. No. 5,579,208, to Zhen et al., issued Jun. 2, 1998, incorporated above.

Other Components—Other optional ingredients for the compositions herein include but are not limited to hydrotropes, antibacterial agents, additional enzyme stabilizers and perfumes. Especially desirable are anti-shrinkage agents, anti-wrinkle agents, fabric crisping agents and other fabric color protection agents. The pH of the composition as disclosed here will be between 5 and 9.

Part the Second: Combination Washing/Conditioning Composition

The present invention also relates to a washing/conditioning composition which provides not only detersive and cleaning benefits on dry-clean only garments but also the through-the-wash softening and conditioning. This greatly enhances the convenience of the overall process to the consumer because the conditioning agent is added at the beginning of the wash cycle and does not need to be added subsequently during the rinse cycle. In addition to its cleaning benefits, the combination washing/conditioning solution provides a number of important benefits: such as improved color fidelity, improved abrasion resistance and excessive wrinkling prevention. Fabric softeners also help maintain fabric softness of garments such as silk, which can have a rough feel after being washed in an aqueous laundry detergent. Thus particularly important for the present combination washing/conditioning composition are additives which act as anti-shrinkage agents, anti-wrinkle agents, fabric crisping agents and other fabric color protection agents.

Many of the ingredients for the washing/conditioning composition have been described above in the section on the wash pretreatment composition and will not be duplicated here. In addition to those ingredients, the following optional and essential ingredients will be selected by the skilled formulator for use in the washing/conditioning composition. Still further ingredients suitable for use in the present invention are further disclosed in U.S. Pat. No. 5,460,736, Trinh et al., issued Oct. 24, 1995; U.S. Pat. No. 5,545,350, Baker et al., issued Aug. 13, 1996; U.S. Pat. No. 5,562,849, Wahl et al., issued Oct. 8, 1996; all of which are hereby incorporated by reference. Quaternary Ammonium Surfactants—As an essential component, the combination washing/conditioning compositions herein contain from about 1% to about 10%, preferably from about 2% to about 7%, more preferably from about 3% to about 5% by weight of a quaternary ammonium surfactant of the formula:

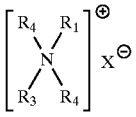

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6$–$C_{18}$ alkyl, and $R_4$ is selected from the group consisting of $C_1$–$C_{10}$ alkyl, $C_1$–$C_{10}$ hydroxyalkyl, benzyl, and —$(C_2H_4O)_xH$ where x has a value from 2 to 5.

Preferred quaternary ammonium surfactants are the chloride, bromide, and methylsulfate salts. Examples of preferred mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_{8-18}$ alkyl and $R_1$, $R_2$, and $R_4$ are selected from methyl and hydroxyalkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethyl-monohydroxy-ethylammonium chloride, coconut dimethyl-monohydroxyethylammonium methylsulfate, steryal dimethyl-monohydroxy-ethylammonium chloride, steryal dimethyl-monohydroxyethylammonium methylsulfate, di-$C_{12}$–$C_{14}$ alkyl dimethyl ammonium chloride, and mixtures thereof are particularly preferred.

Ratio of Anionic Surfactants to Quaternary Ammonium Surfactants—Anionic surfactants and quaternary ammonium surfactants are both essential components of the present invention. When they are present together within a certain weight ratio they form a mixed micellar system within the composition so that while the washing/conditioning composition is sufficiently viscous to suspend silicone softening agent emulsions and other polymers, the compositions are simultaneously not so viscous and thick that they cannot be easily and conveniently poured out of a detergent bottle in which they are contained.

In order to achieve the optimum balance of phase stability/suspension benefits and product viscosity it is preferable that the weight ratio of anionic surfactants to quaternary ammonium surfactants be from about 2:1 to about 3:1, preferably from about 2.2:1 to about 2.8:1. While U.S. Pat. No. 5,759,208 also discloses the combination of anionic and quaternary ammonium surfactants, the ratio of anionic to quaternary surfactant (over 5:1) is significantly higher than the ratios used in the present invention.

Enzymes—As discussed above, enzymes enhance cleaning and removal on a wide variety of stains, including of protein-based, carbohydrate-based, or triglyceride-based stains. In the present combination washing/conditioning compositions, certain enzymes also provide fabric restorative benefits by decomposing and degrading the loose and frayed fibers on the surface of a textile article, particularly textile articles made from silk or wool. Mannanase enzymes and amylase enzymes are preferred for use in the washing/cleaning compositions because of their stain removal benefits. As mentioned above, enzymes such as cellulases and peroxidases are less desirable.

A particularly preferred amylase enzyme is NATALASE® which can be specified as an a-amylase having a specific activity at least 25% higher than the specific activity of Termamylâ at a temperature range of 25° C. to 55° C. and at a pH value in the range of 8 to 10, measured by the Phadebasâ a-amylase activity assay.

Silicone Softening Agents and Emulsions thereof—The present invention may also include a variety of silicone oils (preferably prepared in the form of an emulsion) which have been discovered to impart a significantly smoother feel to most types of fabrics and also significantly reduce the amount of wrinkle formation. The silicone softening agent may or may not be present in the form of an emulsion.

Silicone softening agents include polyalkyl or polyaryl siloxanes which conform to the following formula

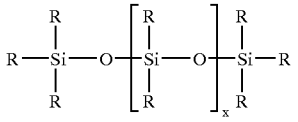

where R is aliphatic, preferably alkyl or alkenyl, or aryl, R can be substituted or unsubstituted, and x is an integer from 1 to about 8,000. Suitable unsubstituted R groups include alkoxy, aryloxy, arylalkyl, arylalkenyl, alkylamine, and ether-substituted, hydroxyl-substituted, and halogen-substituted aliphatic and aryl groups. Suitable R groups also include cationic amines and quaternary ammonium groups.

The aliphatic or aryl groups substituted on the siloxane chain may have any structure so long as the resulting silicones remain fluid at room temperature, are hydrophobic, are neither damaging or otherwise harmful when applied to textile articles, are compatible with the other components of the detergent composition, are chemically stable under normal use and storage conditions and are capable of being deposited on and conditioning textile articles according to the methods outlined in the present invention.

The two R groups on the silicon atom of each monomeric silicone unit may represent the same or different groups. Preferably, the two R groups represent the same group.

Preferred alkyl and alkenyl substituents are $C_1$–$C_5$ alkyls and alkenyls, more preferably from $C_1$–$C_4$, most preferably from $C_1$–$C_2$. The aliphatic portions of other alkyl-, alkenyl-, or alkynyl-containing groups (such as alkoxy, arylalkyl, and alkylamino) can be straight or branched chains and preferably have from one to five carbon atoms, more preferably from one to four carbon atoms, even more preferably from one to three carbon atoms, most preferably from one to two carbon atoms.

Further suitable R groups include methyl, ethyl, propyl, phenyl, methylphenyl and phenylmethyl. The preferred silicones are polydimethylsiloxane, polydiethylsiloxane, and polymethylphenylsiloxane. Polydimethylsiloxane is especially preferred. Other suitable R groups include methyl, methoxy, ethoxy, polyethoxy, propoxy, and aryloxy. The three R groups on the end caps of the silicone may also represent the same or different groups.

Other preferred silicones include nonionic polyalkylene oxide-modified polydimethylsiloxanes which are especially effective at wrinkle reduction. Such silicone fluids are available from the OSI Specialties Company under the name SILWET®. SILWET® L77, which is a mixture of 84% polyalkyleneoxide modified heptamethyltrisiloxane and 16% allyloxypolyethyleneglycol methyl ether, is particularly preferred.

Further discussion and examples of silicone oils suitable for use in the present invention may be found in U.S. Pat. No. 5,874,073, to Kaiser et al., issued on Feb. 23, 1999, which is hereby incorporated by reference. It may be desirable to incorporate emulsifiers at concentrations effective for emulsifying the silicone conditioning agents. (As used herein, "emulsifiers" include suspending agents.) Emulsifiers and suspending agents are discussed in further detail in U.S. Pat. No. 5,874,073 and U.S. Pat. No. 5,759,208, both of which are incorporated above. Particularly preferred are emulsifying surfactants disclosed in U.S. Pat. No. 5,759,208, which added to the silicone fluid to form an emulsion.

Cyclic amine Based Polymer, Oligomer or Copolymer Materials—It is preferred that the combination washing/conditioning compositions of the present invention comprises one or more cyclic amine based polymer, oligomer or copolymer. Such materials have been found to impart a number of appearance benefits to fabrics and textiles laundered in aqueous washing solutions formed from detergent compositions which contain a mixture of cyclic amine based polymers, oligomers or copolymers and hydrophobically modified cellulosic based polymers or oligomers fabric treatment materials. Such fabric appearance benefits can include, for example, improved overall appearance of the laundered fabrics, reduction of the formation of pills and fuzz, protection against color fading, improved abrasion resistance, etc. The cyclic amine based fabric treatment materials used in the compositions and methods herein can provide such fabric appearance benefits with acceptably little or no loss in cleaning performance provided by the laundry detergent compositions into which such materials are incorporated.

The cyclic amine based polymer, oligomer or copolymer component of the compositions herein may comprise combinations of these cyclic amine based materials. For example, a mixture of piperidine and epihalohydrin condensates can be combined with a mixture of morpholine and epihalohydrin condensates to achieve the desired fabric treatment results. Moreover, the molecular weight of cyclic amine based fabric treatment materials can vary within the mixture as is illustrated in the Examples below.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers polymerized from a mixture of a primary cyclic amine based monomer, e.g., piperidine, and a secondary cyclic amine monomer, e.g., morpholine.

The mixture of cyclic amine based polymers, oligomers or copolymers and hydrophobically modified cellulosic based polymers or oligomers of the detergent compositions herein will generally comprise from about 0.01% to about 5% by the weight of the detergent composition. More preferably, the mixture of cyclic amine based polymers, oligomers or copolymers and hydrophobically modified cellulosic based polymers or oligomers will comprise from about 0.1% to about 4% by weight of the detergent compositions, most preferably from about 0.75% to about 3%. However, as discussed above, when used as a washing solution additive, i.e. when mixture of cyclic amine based polymers, oligomers or copolymers and hydrophobically modified cellulosic based polymers or oligomers are not incorporated into a detergent composition, the concentration of mixture of cyclic amine based polymers, oligomers or copolymers and hydrophobically modified cellulosic based polymers or oligomers can comprise from about 0.1% to about 80% by weight of the additive material.

Preferred cyclic amine based polymer, oligomer or copolymer materials which are suitable for use in laundry operations and provide the desired fabric appearance and integrity benefits are described in further detail in the copending provisional patent application of Panandiker et al., entitled "Laundry Detergent Compositions With A Combination Of Cyclic Amine Based Polymers And Hydrophobically Modified Carboxy Methyl Cellulose," having Ser. No. 60/148,053, filed on Aug. 10, 1999, which is hereby incorporated by reference.

Polymeric Soil Release Agent—Soil release agents may be used in the present invention. If so they will generally comprise from about 0.01% to about 10.0%, by weight, of the detergent compositions herein, typically from about 0.1% to about 5%, preferably from about 0.2% to about 3.0%.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and its blends, and hydrophobic segments, to deposit upon hydrophobic fibers and remain adhered thereto through completion of washing and rinsing cycles and thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Other suitable polymeric soil release agents are disclosed in U.S. Pat. No. 5,415,807, issued May 16, 1995 to Gosselink, which is hereby incorporated by reference.

Combinations of Fabric Care Components—While they may be effectively used separately, it is preferred that cyclic amine based polymer/oligomer/copolymer materials and dye transfer inhibiting agents such as polyvinyl pyrrolidone polymers, polyamine N-oxide polymers, copolymers of N-vinylpyrrolidone and N-vinylimidazole, manganese phthalocyanine and peroxidases (described above in the section on wash pretreatment compositions) be used in combination to provide optimum suppression of dye-transfer between garments, particularly in mixed colored loads (i.e. mixed light and dark-colored fabrics).

The Flexible Wrap Container

The action of the agitator in a clothes washer has long been known to expose delicate fabrics to sufficient abrasion and stress that severe damage can occur as a result. As a result, bags have been developed which can be used in a washing machine to protect these garments from abrasion and stress. Nonetheless these have proved unsatisfactory for a variety of reasons. First, they are generally too small to contain anything but one or two small garments—and even then may bunch-up the garments and exacerbate wrinkling and shape loss. Second, many of these bags do not have a reliable closure means, and so the bag often comes open during washing, depriving the garments of the protection the bag is supposed to provide and likely increasing the abrasion and wear on the garments. Third, these bags are often constructed to have an outer shell made of a grid-like netting which allows contact between the wash liquor and the garment to provide cleaning benefits; but this grid-like pattern can also leave an identical grid impression on the garments contained inside. Such a pattern may be virtually impossible to iron out. Fourth, these bags are generally too thin and do not provide enough cushion from the abrasion and stress that a delicate garment may experience in a laundry washing machine.

Figure 1A:
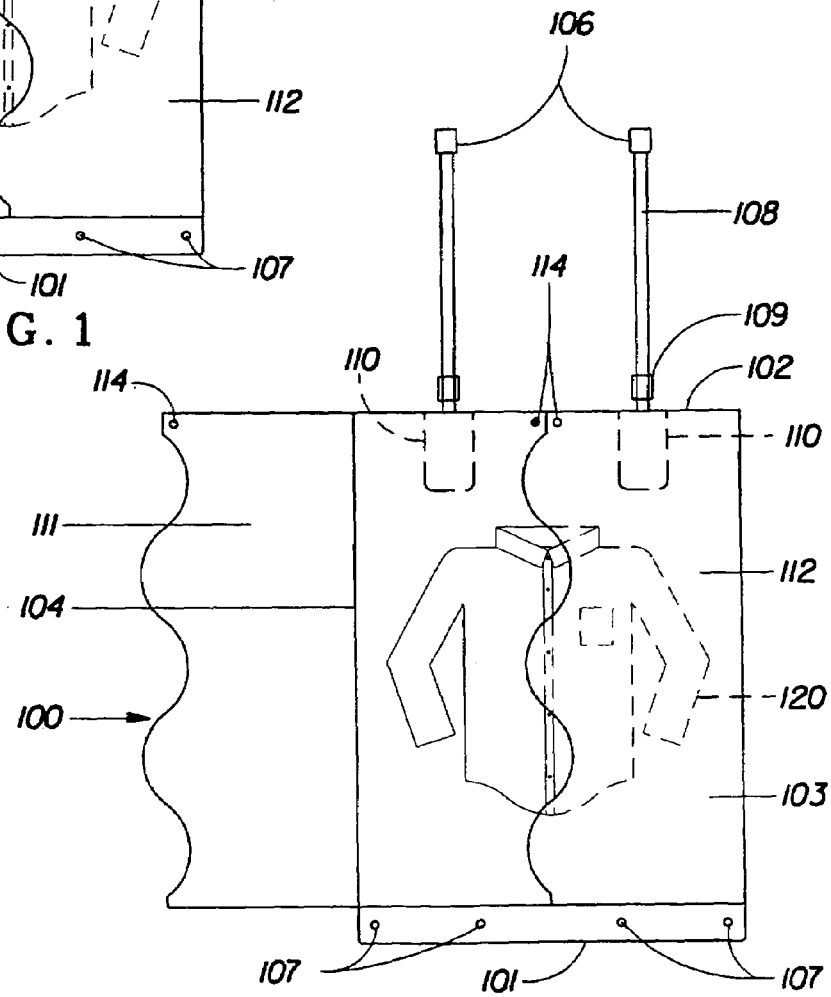
FIG. 1A is a side view illustrating the flexible wrap container 122 and showing two attached flaps, a first flap 111 being folded out and a second flap 112 being folded over the panel.
Figure 2:
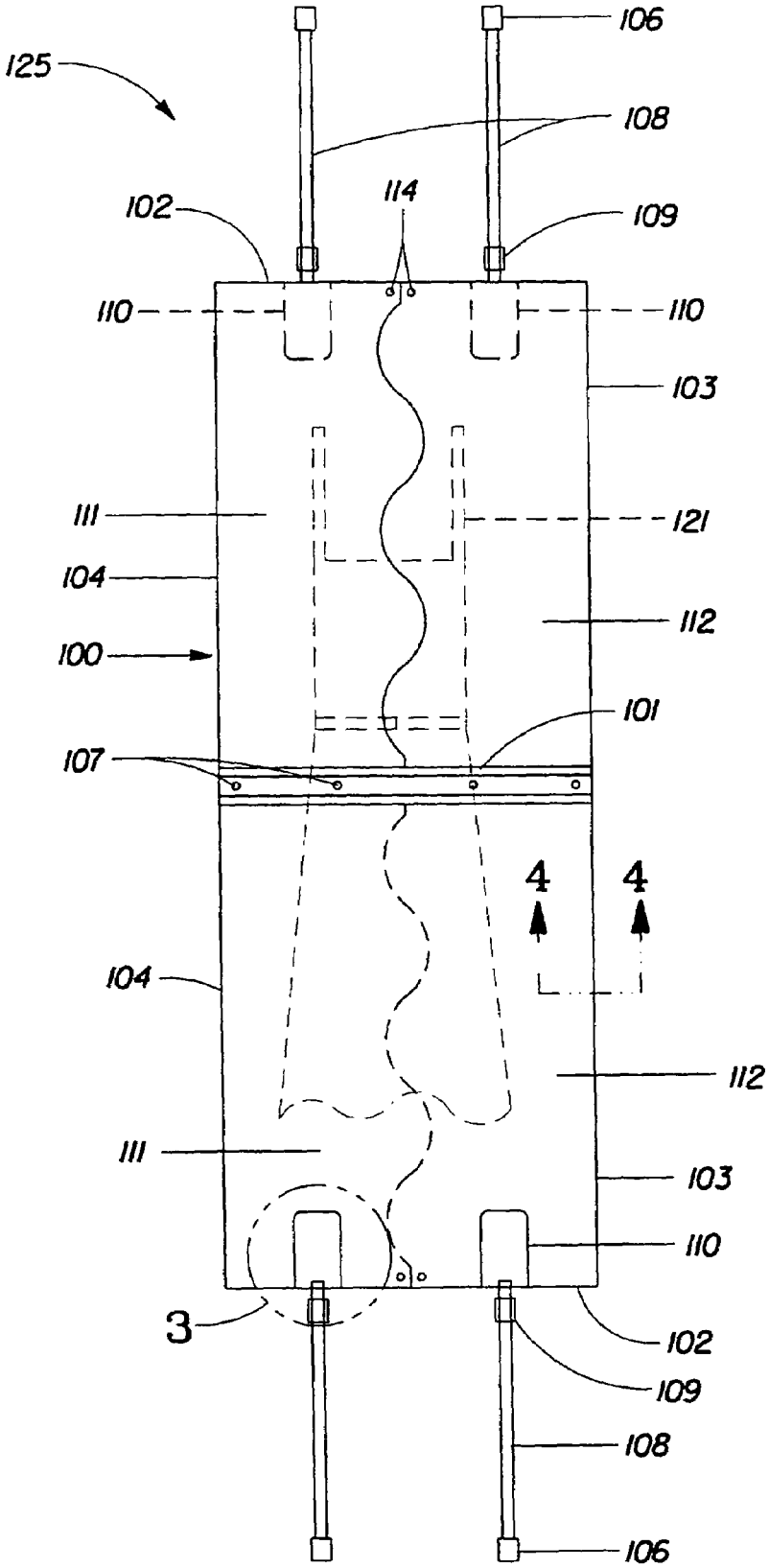
FIG. 2 is a side view illustrating an enlarged flexible wrap container 125. In this embodiment, the two wraps can be attached to each other via connecting means 107 located adjacent to the bottom edge of the panel 101 of each flexible wrap container 122 to form an enlarged flexible wrap container 125.
Figure 3:
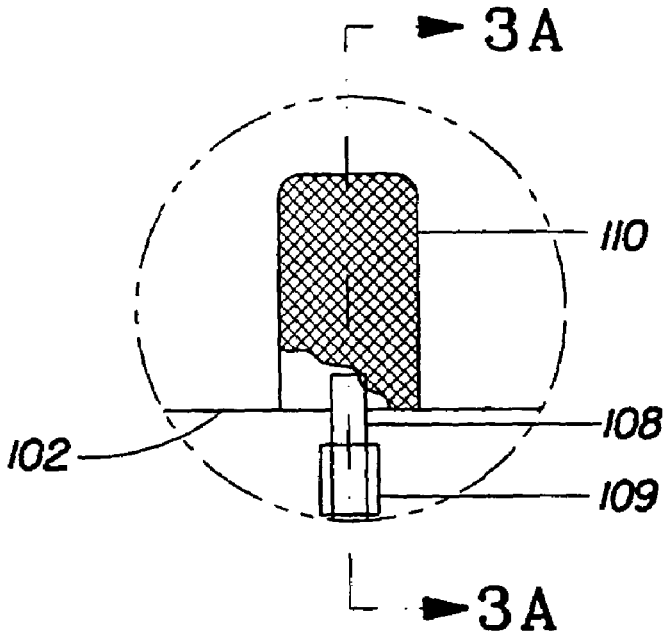
FIG. 3 is a detail illustrating a pocket 110 attached to the panel 100 of the flexible wrap container which provides a storage area for the extra straps and fastening devices when two flexible wrap containers are attached to form an enlarged flexible wrap container as in FIG. 2.
Figure 3A:
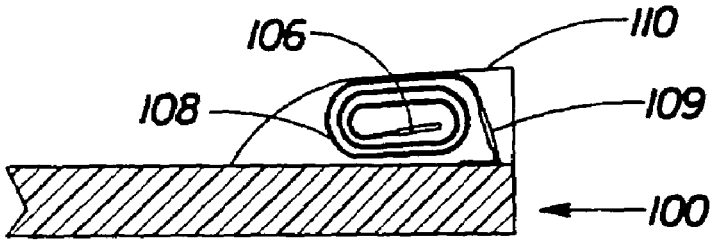
FIG. 3A is a sectional side view of the pocket 110 illustrating the storing of straps and fastening devices in the attached pockets when two flexible wrap containers are attached to form an enlarged flexible wrap container as in FIG. 2
Figure 4:
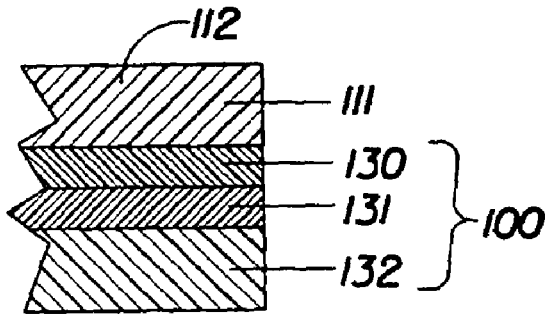
FIG. 4 is an enlarged sectional view showing a profile of the material layers in a preferred embodiment of the flexible wrap container 122.

A preferred flexible wrap container ("wrap") made in accordance with the present invention which remedies many of these problems is shown in FIGS. 1, 1A and 2. The wrap 122 comprises a single, preferably rectangular, panel 100. The dimensions of the panel 100 are such that the width will be about 31 cm to about 91 cm and the length will be about 55 cm to about 117 cm; more preferred is a width of about 41 cm to about 81 cm and a length of about 66 cm to about 107 cm and most preferred is a width of about 51 cm to about 71 cm and a length of about 76 cm to about 97 cm. In a rectangular embodiment as depicted in FIG. 1, the distance from the top edge of the panel 102 to the bottom edge of the panel 101 is greater than the distance from the right edge of the panel 103 to the left edge of the panel 104.

The wrap further comprises one or more straps 108 which are attached adjacent to the top edge of the panel 102. At an end of each strap is a first fastening device 109 which is fixably and permanently attached to each strap 108 so that its position on the strap does not change. A second fastening device 106 is preferably attached to each strap by passing the strap through the fastening device in such a way that changing its position on the strap, the length of the strap 105 can be increased or decreased. The first and second fastening devices cooperate to secure the flexible wrap container in a roll-like shape during use (see, e.g., FIG. 7). Additionally, two pockets 110 are attached adjacent to the top edge of the panel in the manner shown by FIGS. 1, 1A, 2 and 3. The wrap container, along with its preferred embodiments, is discussed in more detail in the copending provisional application of Curry et al., entitled "Methods for Laundering Delicate Garments in a Washing Machine," having P&G Case No. 7315P2, incorporated above.

The Wash Pretreatment Applicator

The wash pretreatment applicator to be used in the present invention can essentially be any non-abrasive tool with which one can apply an effective amount of a wash pretreatment composition to a stained area of a garment while simultaneously effectively providing mechanical action to assist in the stain removal. Thus an object as simple as a human finger may serve as the wash pretreatment applicator. A preferred embodiment as the applicator is disclosed in the copending provisional application of Curry et al., entitled "Methods for Laundering Delicate Garments in a Washing Machine," having P&G Case No. 7315P2, incorporated above.

Absorbent Stain Receiver

The absorbent stain receiver which is used in the present invention includes an absorbent material which imbibes the liquid composition. In preferred modes of operation, the stain receiver is designed specifically to "wick" or "draw" the liquid compositions away from the stained area. The absorbent stain receiver is necessarily white or non-printed to avoid dye transfer from receiver to garment. White or non-printed disposable paper towels, such as BOUNTY™ brand towels, clean rags, etc., can be used. A preferred receiver consists of a nonwoven pad. Additional materials which may be serve as an absorbent stain receiver are disclosed in the copending provisional application of Curry et al., entitled "Methods for Laundering Delicate Garments in a Washing Machine," having P&G Case No. 7315P2, incorporated above.

Process Embodiments

The use of the devices, compositions and processes of this invention are described in more detail hereinafter. Such disclosure is by way of illustration and not limitation of the invention herein.

Although not necessary or essential to the present invention, it is preferable to use a pretreatment procedure to improve the effectiveness of removing stains from a stained area of the garment. This pretreatment procedure comprises pouring a pretreatment composition to the stained area and then distributing and spreading the pretreatment composition over the stained area with the wash pretreatment applicator by applying a gentle brushing motion to distribute the pretreatment composition around the stained area of the garment. The pretreatment composition is then optionally rinsed off the stained area with water.

In more detail, the pretreatment process herein can be conducted in the following manner. Modifications of the process can be practiced without departing from the spirit and scope of the present invention.

1. Place the stained area of the garment over and in contact with an absorbent stain receiver such as a FAM absorbency pad or a paper towel (preferably a nonwoven pad that is white or non-printed-to avoid dye transfer from towel to garment) or any other stain receiver as described herein on any suitable surface such as a table top etc. Pour the wash pretreatment composition onto the stained area.
2. Use the wash pretreatment applicator to spread, in a gentle brushing motion, the pretreatment composition onto the stained area to saturate the localized stained area without saturating the area surrounding it and then subsequently attempting to work out the stain as completely as possible.
3. Optionally, let the composition penetrate the stain for about 1 to 3 minutes.
4. Optionally, apply more of the pretreatment composition onto the stained area.
5. Optionally, rinse the stained area that has been pre-treated with cold tap water.
6. Follow this pretreatment process with the overall cleaning process described below.

An overall process for treating an entire fabric surface area of a garment, which includes the pretreatment process described above, thus comprises the following steps of:

(i) Optionally, conducting a pretreatment process, according to steps 1–6 of the above disclosure, on a stained area of a garment.

(ii) Placing the pretreated garment from step (i) inside the washing implement in the manner disclosed herein and securing the washing implement so that it will not come open during laundering in the washing machine.

(iii) Placing the washing implement inside a washing machine together with a measured amount of the combination washing/conditioning composition.

(iv) Operating the washing machine on its most gentle agitation cycle and using cold water both in the wash and rinse cycles for a period of at least about 6 minutes, typically from about 4 minutes to about 12 minutes.

(v) Removing the flexible wrap container containing the clean garments from the washing machine, removing the garment or garments from the flexible wrap container and either allowing them to air dry or first placing them in a clothes dryer set on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. The garments should then be removed and allowed to air dry. Wool garments shold not be placed in a clothes dryer.

With respect to step (ii), it is appreciated that for fabrics which tend to wrinkle, it is preferred not to overload the washing implement used herein.

In step (iii), the washing machine may have an agitator arranged on either a substantially horizontal or substantially vertical axis. Typically, such an amount of liquid cleaning/conditioning composition will be added so that the concentration of active ingredients in the wash liquor is from about 300 ppm to 2500 ppm, more preferably from about 400 ppm to about 2000 ppm, most preferably from about 500 ppm to about 1600 ppm. Step (iv) can be conducted for longer or shorter periods, depending on such factors as the degree and type of soiling of the fabrics, the nature of the soils, the nature of the fabrics, the fabric load and the like according to the needs of the user.

EXAMPLE I

Examples of a (1) preferred wash pretreatment composition to be used in the pretreatment process; and (2) a washing/conditioning composition to be added during the wash cycle. The compositions are used in a manner described after the detailed formulations.

Wash Pretreatment Composition

| INGREDIENT | wt % |
|---|---|
| Nonionic Surfactant | 0.50 |
| N-Cocoyl N-Methyl Glucamine | 1.60 |
| Anionic Surfactant | 16.00 |
| Amine Cosurfactant | 0.40 |
| Citric Acid | 2.50 |
| Fatty Acids (12–16) | 2.00 |
| Ethanol | 2.59 |
| Monoethanol amine | 0.75 |
| Sodium Formate | 0.062 |
| Propanediol | 5.08 |
| Tolulene Sulfonate | 0.36 |
| Borax Premix | 2.50 |
| Sodium Hydroxide | 2.62 |
| Fabric Care Agents | 2.70 |
| Enzymes | 0.15 |
| Balance (water, antifoaming agent, perfume, color stabilizers) | 61.67 |

Washing/Conditioning Composition

| Comnonent | Weight % |
|---|---|
| Anionic Surfactant[1] | 14.40 |
| Nonionic Surfactant[2] | 4.00 |
| Lauryl trimethyl ammonium chloride | 5.33 |
| Citric Acid | 0.70 |
| Ethanol | 2.10 |
| Monoethanol amine | 0.75 |
| Sodium Formate | 0.06 |
| Propanediol | 3.67 |

-continued

| Washing/Conditioning Composition | |
|---|---|
| Comnonent | Weight % |
| Tolulene Sulfonate | 0.36 |
| Borax premix | 2.50 |
| NaOH | 0.1 |
| Ethoylated Tetraethylene Penatamine | 0.90 |
| PVNO | 0.37 |
| Cyclic Polymer[3] | 0.55 |
| Enzymes | 0.50 |
| Silicone softening agent[4] | 5.00 |
| Perfumes, Dyes and other minors | 0.50 |
| Water | Balance |

[1]C12–15 alkyl ethoxy sulfonate containing an average of 1.8 ethoxy groups.
[2]Neodol 45-7
[3]Imidazole-epi (condensation oligomer produced by condensation of imidazole and epichloro-hydrin in the ratio 1:4:1). The composition is about 94% oligomer and 6% free imidazole
[4]The silicone softening agent may be either a blend of Dimethicone and Ammonium alkyl sulfonate containing an average of 3 ethoxy groups or may be the SILWET ® L77 surfactant which is a mixture of 84% polyalkyleneoxide modified heptamethyltrisiloxane (the "active" ingredient) and 16% allyloxypolyethyleneglycol methyl ether. The silicone softening agent may be in the form of an emulsion.

Step 1. One or more garments to be cleaned and refreshed are selected. Stains on a garment from sources such as ink, lipstick, salad dressing, collar soil and other similar sources are then identified and selected for pretreatment. For pretreatment, localized stained areas of the garment are situated over a paper towel and are treated by directly applying about 0.5 to 5 mls (depending on the size of the stain) of the wash pretreatment product of Example I, which is gently worked into the garment using the wash pretreatment applicator. Excess liquid product is then washed off the stain with running cold tap water.

Step 2. The flexible wrap container is laid flat on an even surface such as a table or clothes dryer. A first garment such as a jacket is placed on the wrap. The sleeves and other extensions of the garment should be folded-in if necessary and none of the garment may lie outside the perimeter of the wrap. After the first garment has been laid on the wrap, the wrap's flaps are folded over the garment so that the entire garment is enclosed by the wrap. An additional garment may then be placed over the folded flaps following the same procedure described above and being careful that none of the garment lies outside the perimeter of the flexible wrap container.

Step 3. The wrap is then rolled up as if one were rolling up a sleeping bag. The wrap is rolled in a direction parallel to the longest edge of the wrap, starting from the edge with close proximity to the connecting means. After the bag has been rolled up, it is secured by means of the straps and fasteners so that the straps holding the bag are pulled taut.

Step 4. The garment-containing wrap is then placed in a washing machine. Preferably two garment-containing wraps of approximately equal weight are placed in the washing machine simultaneously to insure a balanced load. The washing machine settings should be set on: medium water level (approximately 17 gallons), cold water and the most gentle agitation setting. Two capfuls of the combination washing/conditioning composition of Example I (about 66 ml) are poured into the washing machine; 66 ml of the liquid product of Example I in 17 gallons of water means that the total concentration of liquid cleaning composition in the detergent/water solution will be about 1090 ppm.

Step 5. When the washing machine has completed all of its cycles, the garment-containing wraps are removed from the washing machine and the garments inside the wraps are removed from the wrap. With the exception of men's ties and wool garments, one may dry the garments by placing them in a dryer and setting the dryer on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. One then removes the damp garment from the dryer and may then hang the garment or lay it flat to finish drying. For men's ties and wools the dryer step is inappropriate and air drying should begin immediately after they are removed from the washing machine.

Step 6. Press or steam the garments if necessary.

What is claimed is:

1. A kit comprising:

(a) a flexible wrap container comprising:

a flexible panel having a right edge, a left edge, a top edge, and a bottom edge;

at least one strap and a first fastening device attached to said strap for securing the wrap container in a roll-like shape;

a first flap attached to said right edge of said flexible panel; and a second flap attached to said left edge of said flexible panel, wherein said first and second flaps overlap when folded about their respective edges;

(b) instructions for using the flexible wrap container, the instructions being enclosed with or on a container enclosing the kit; and (c) a liquid detergent composition suitable for washing and conditioning delicate fabrics comprising:

i) an anionic surfactant;

ii) a quaternary ammonium surfactant;

iii) a silicone softening agent; and iv) optionally, an emulsifier;

wherein the weight ratio of anionic surfactants to quaternary ammonium surfactants is from about 2:1 to about 3:1, preferably from about 2.2:1 to about 2.8:1.

2. A kit according to claim 1 wherein the kit further comprises a wash pretreatment composition comprising surfactants, enzymes and water.

3. A kit according to claim 1 wherein the flexible wrap container at standard temperature and pressure has a density of greater than about 1 g/cm$^3$.

4. A kit according to claim 2 wherein the wash pretreatment composition further comprises ingredients selected from the group consisting of: detersive surfactants, enzymes, dye transfer inhibiting polymers, soil release agents, detergent builders, non-detersive surfactants, dispersant polymers, water, ethanol and mixtures thereof.

5. A process comprising the steps of:

(a) placing a garment within a flexible wrap container, the flexible wrap container comprising:

(i) a flexible panel constructed from a material selected from the group consisting of woven polyester, woven nylon or a combination thereof; the flexible panel has a right edge, a left edge, a top edge and a bottom edge;

(ii) at least two connecting means located adjacent to the bottom edge of the flexible panel for the purpose of attaching the flexible wrap container to a second flexible wrap container;

(iii) a first and a second strap, each strap attached adjacent to the top edge of the flexible panel; and (iv) a first fastening device which is fixably and permanently attached to the first or second strap, so that the first fastening device's position on the strap does not change, and a second fastening device, attached to the first or second strap by passing the strap through the second fastening device in such a way that by changing the second fastening device's position on the strap, the length of the strap can be increased or decreased;

(b) placing the flexible wrap container together with an effective amount of a liquid detergent composition suitable for washing and conditioning delicate fabrics inside a washing machine wherein the detergent composition comprises:

i) an anionic surfactant;

ii) a quaternary ammonium surfactant;

iii) a silicone softening agent; and iv) optionally, an emulsifier;

wherein the weight ratio of anionic surfactants to quaternary ammonium surfactants is from about 2:1 to about 3:1, preferably from about 2.2:1 to about 2.8:1; and (c) operating the washing machine as directed by the manufacturer.

6. The process according to claim 5 wherein before step (a), the process further comprises the steps of:

(i) applying a wash pretreatment composition directly to a stain, the stain being in contact with an absorbent material covering a localized area of the garment intended to be washed;

(ii) concurrently with step (i), applying mechanical action to the stain by means of a wash pretreatment applicator, whereby the stain is transferred into the absorbent material; and (iii) optionally, rinsing the wash pretreatment composition off the localized area of the garment.

7. A kit according to claim 1 wherein the silicone softening agent is a polyalkylene oxide-modified polydimethylsiloxane.

8. A process according to claim 5 wherein the silicone softening agent is a polyalkylene oxide-modified polydimethylsiloxane.

9. A process according to claim 5 wherein improved ironing efficiency of the garment results therefrom.

10. A process according to claim 9 wherein reduced wrinkling of the garment results therefrom.

11. A process according to claim 9 wherein the garment is composed of silk fibers.

* * * * *